United States Patent [19]

Waddington

[11] Patent Number: 4,840,560

[45] Date of Patent: Jun. 20, 1989

[54] HEATING STOCK IN A HEATING CHAMBER

[75] Inventor: John D. Waddington, Solihull, United Kingdom

[73] Assignee: British Gas PLC, London, England

[21] Appl. No.: 125,333

[22] Filed: Nov. 25, 1987

[30] Foreign Application Priority Data

Jan. 3, 1987 [GB] United Kingdom ..... 8700219

[51] Int. Cl.[4] ..... F27B 9/28

[52] U.S. Cl. ..... 432/59; 432/121; 432/180; 432/236; 432/246

[58] Field of Search ..... 432/8, 59, 121, 180, 432/236, 246

[56] References Cited

U.S. PATENT DOCUMENTS

| | | | |
|---|---|---|---|
| 3,712,597 | 1/1973 | Waitkus et al. | 432/180 |
| 4,160,641 | 7/1979 | Miskolczy et al. | 432/130 |
| 4,251,062 | 2/1981 | Pobuda et al. | 432/246 |
| 4,303,388 | 12/1981 | Elhaus | 432/236 |
| 4,410,308 | 10/1983 | McElroy | 432/59 |
| 4,529,379 | 7/1985 | DiCastri | 432/59 |
| 4,620,840 | 11/1986 | Hilge et al. | 432/121 |

*Primary Examiner*—Henry C. Yuen
*Attorney, Agent, or Firm*—Larson and Taylor

[57] ABSTRACT

A method for heating stock comprises feeding stock 9 to be heated into a heating chamber 1, causing heating gas to enter the heating chamber 1 to heat the stock 9 and leave the heating chamber 1 after heating the stock 9 and then removing the stock 9 from the heating chamber 1 on completion of heating, the heating gas being allowed to enter the heating chamber 1 by way of a plenum chamber 2,3 which communicates with the heating chamber 1. The heating gas may be supplied by a regenerative burner 4,5 as fuel combustion products. Where there are two such burners 4,5 one may be firing while the other is flueing.

1 Claim, 2 Drawing Sheets

HEATING STOCK IN A HEATING CHAMBER

The present invention relates to the heating of stock in a heating chamber to which a heating gas is supplied to heat the stock. According to one aspect of the invention, a method is provided for heating stock comprising feeding stock to be heated into a heating chamber, causing heating gas to enter the heating chamber to heat the stock and leave the heating chamber after heating the stock and then removing the stock from the heating chamber on completion of heating, the heating gas being allowed to enter the heating chamber by way of a plenum chamber which communicates with the heating chamber.

According to another aspect of the present invention apparatus is provided for heating stock comprising a heating chamber for receiving the stock for heating with a heating gas, a plenum chamber which communicates with the heating chamber, a fuel-fired burner for supplying heating gas to the plenum chamber for distribution to the heating chamber, there being means for exhausting waste gas from the heating chamber.

According to a further aspect of the present invention apparatus is provided for heating stock comprising a heating chamber for receiving the stock for heating with a heating gas, a first plenum chamber adjoining a first side of the heating chamber and communicating with the chamber through the first side, a second plenum chamber adjoining a second side of the heating chamber and communicating with the chamber through the second side, a first regenerative type burner communicating with the first plenum chamber and a second regenerative type burner communicating with the second plenum chamber, each burner being adapted on its firing cycle to supply heating gas to its plenum chamber for subsequent distribution to the heating chamber for heating the stock and on its flueing cycle to receive from its plenum chamber waste gas discharged from the heating chamber, the arrangement being that, in use, while one burner is firing the other is flueing.

Figure 1:
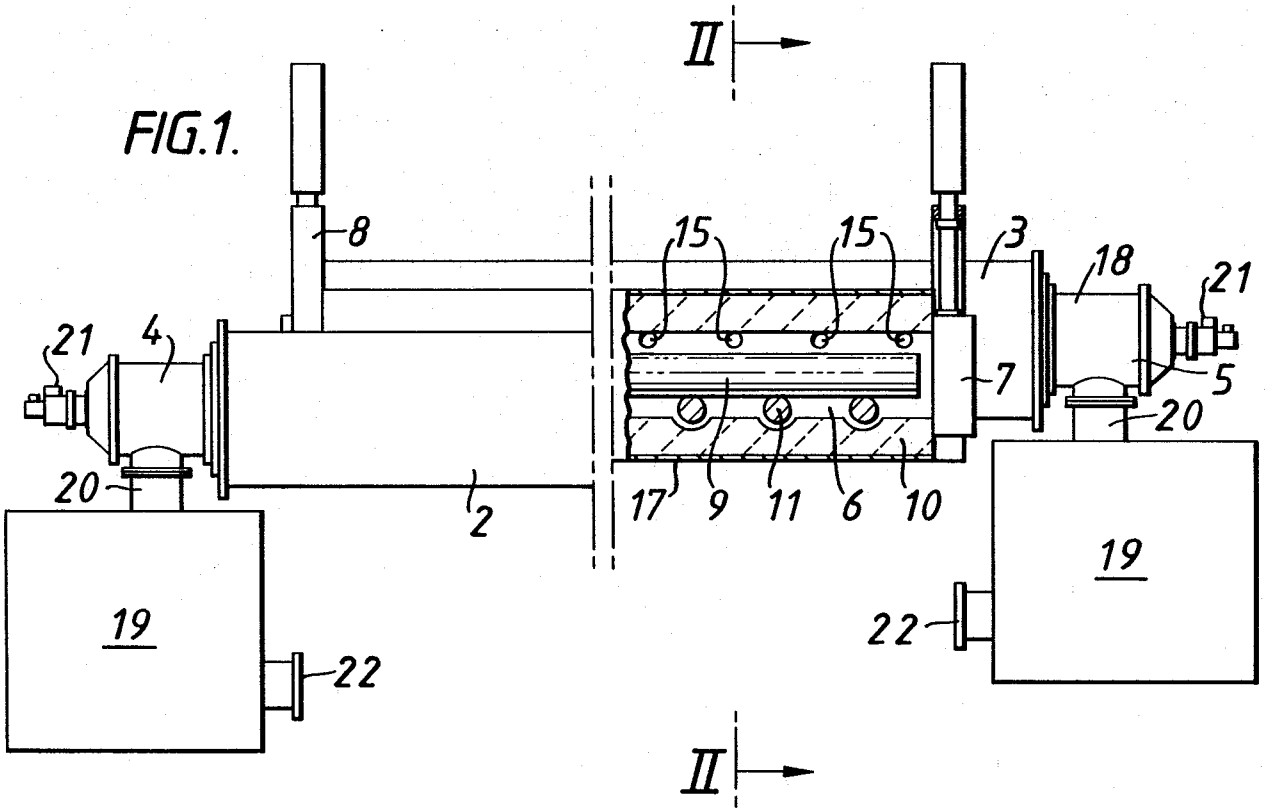
Figure 2:
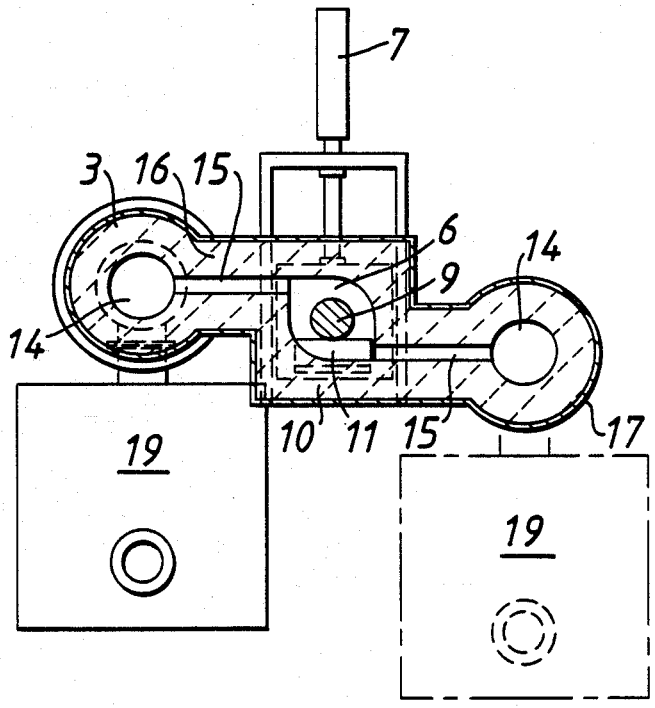

An embodiment of the invention will now be particularly described with reference to the drawings in which:

FIG. 1 is a side elevation partly in section of an apparatus for heating stock, and FIG. 2 is a view along the lines II—II of FIG. 1.

Referring to the drawings, the apparatus comprises a heating chamber 1, two plenum chambers 2, 3, each communicating with the heating chamber 1 and a pair of regenerative type burners 4, 5, one burner communicating with a matching plenum chamber.

The heating chamber 1 comprises an elongate generally rectangular or circular cross section furnace which is designed to reheat metal stock such as large section round or square billets.

The chamber 1 forms an elongate enclosure 6 to receive the stock to be heated such as a long billet (eg. an aluminum log) or a multiplicity of billets (such as those used in forging or extrusion). The enclosure 6 is closed at either end by doors 7 and 8 which are raisable vertically to permit entry and discharge of a billet (such as that shown by reference 9). The billet 9 enters via door 7 and leaves via door 8.

The floor 10 of the enclosure 6 is provided with a means of stock conveying such as driven rolls 11 along which the billet 9 can be moved into and out of the enclosure 6.

Along opposite sides of the heating chamber and of the same length, are the plenum chambers 2, 3, each of which forms a generally cylindrical bore 14 extending parallel to the adjoining side of the furnace and each of which communicate with the heating chamber 1 by way of several longitudinally spaced ports 15 along the length of the heating chamber 1. The plenum chamber 2 is displaced slightly vrtically below the plenum chamber 3 and the plenum chambers 2, 3 and the heating chamber 1 are refractory lined 16 and contained in an outermost casing 17.

Each plenum chambers 2, 3 is either closed at one end (not shown) and is provided at the other end with a regenerative type burner 4, 5 each of which is arranged adjacent opposite ends of the heating chamber 1 or provided with regenerative type burners on both ends.

The regenerative burners 4, 5 are of conventional construction and comprise a fuel-fired burner 18 and associated regenerator chamber 19.

In a firing mode each regenerative burner supplies its plenum chamber with heating gas in the form of fuel combustion products. In a flueing mode each burner receives waste gas from its plenum chamber for subsequent discharge.

The regenerator chamber 19 communicates with the burner part 18 by way of a duct 20.

During firing the regenerator chamber 19 supplies the burner part 18 with preheated air by way of the duct 20 for combustion with fuel, eg. natural gas supplied to the burner part 18 by a fuel pipe 21. The air for preheating in the regenerator 19 is supplied to the regenerator 19 by a pipe 22.

During flueing waste gas entering the burner part 18 is discharged to the regenerator chamber 19 by way of the duct 20 and is discharged from the regenerator 19 by way of the pipe 22.

In use, the stock heating can either be "batch" or "continuous" depending upon the process requirements.

In the "batch" mode, which would be used for heating single long metal billets, one burner would fire into its plenum chamber for the complete heating cycle of the one billet within the heating chamber. The other plenum chamber would act as a manifold for receiving the waste combustion products from the heating chamber with the other burner operating in a flueing mode. On completion of the heating cycle the firing burner could be shut down whilst the heated billet was removed from the heating chamber which would be recharged with cold stock. On restart the burner which had previously been flueing would now fire while that burner which had previously been firing would now serve as a flue. This cycle would be repeated.

In "continuous" mode which could be used for heating short billets where the heating chamber would contain a large number of individual billets, each burner firing period could be of predetermined duration, possibly to coincide with the discharge interval of the stock, or alternatively, the firing period could be controlled by the temperature of the waste gases leaving the regenerator of the burner which is flueing.

The provision of the plenum chambers along the sides of the heating chamber enables the heating gas to be distributed to the heating chamber in a far more uniform manner than would be the case if as conventional the burners were to be firing directly into the heating chamber. Furthermore, the provision of plenum chambers enables the number of burners per particular heating chamber to be reduced together with the number and complexity of controls.

I claim:

1. Apparatus for heating stock comprising a heating chamber for receiving stock for heating with a heating gas, a first elongated plenum chamber extending along one side of said heating chamber and having an opening at one end thereof, a second elongated plenum chamber extending adjacent the opposite side of said heating chamber and having an opening at one end thereof, a first plurality of ports communicating said first plenum with said heating chamber, a second plurality of ports communicating said second plenum with said heating chamber, a fist regenerative type burner communicating with the opening at the end of said first plenum, a second regenerative type burner communicating with the opening at the end of said second plenum, each burner being adapted on its firing cycle to supply heating gas to its plenum chamber in a direction parallel to the side of the heating chamber for subsequent distribution to the heating chamber for heating the stock and on its flueing cycle to receive from its plenum chamber waste gas discharged from the heating chamber, the arrangement being that, in use, while one burner is firing the other is flueing.

* * * * *